United States Patent [19]

Goodman

[11] Patent Number: 4,669,573

[45] Date of Patent: Jun. 2, 1987

[54] UNDERWATER ACOUSTIC BAFFLE ENHANCER

[75] Inventor: Jerome Goodman, Baltimore, Md.

[73] Assignee: The United States of America as represented by the Secretary of the Navy, Washington, D.C.

[21] Appl. No.: 704,977

[22] Filed: Feb. 25, 1985

[51] Int. Cl.[4] ..... E04B 1/82

[52] U.S. Cl. ..... 181/286; 181/175; 181/288; 181/290

[58] Field of Search ..... 181/175, 284, 290–293, 181/286, 288

[56] References Cited

U.S. PATENT DOCUMENTS

| | | | |
|---|---|---|---|
| 1,378,420 | 5/1921 | Merritt | 181/175 |
| 2,884,084 | 4/1959 | Sussman | 181/0.5 |
| 3,136,380 | 6/1964 | McCoy et al. | 181/292 X |
| 4,001,473 | 1/1977 | Cook | 428/116 |
| 4,235,303 | 11/1980 | Dhoore et al. | 181/286 X |
| 4,353,768 | 10/1982 | Goodman | 156/253 |
| 4,450,544 | 5/1948 | Denaro et al. | 367/176 |

*Primary Examiner*—Benjamin R. Fuller

*Attorney, Agent, or Firm*—Luther A. Marsh

[57] ABSTRACT

The lightweight underwater acoustic baffle with enhanced performance characteristics particularly at low frequencies is provided by a stiffened resistive screen means affixed in front of a compliant material for allowing the baffle to reflect on the compliant side and on the screen side, a rigid irregular shaped material means with a primary open surface area affixed to the screen as a means for attaining maximum stiffness with a minimum weight, a compliant means affixed behind the screen means, a water fluid sealing and container means within the baffle means for suffusing the stiffening core area and its attached screen for generating miniscule acoustic resistance in the screen and producing a greater impedance mismatch thus enhancing the insertion loss and baffle performance, and, an attachment affixed to the container means for attachment to a vessel.

17 Claims, 10 Drawing Figures

INSERTION LOSS AND ECHO REDUCTION

INSERTION LOSS AND ECHO REDUCTION

EGG CRATE STIFFENER

RECTANGULAR SHAPED STIFFENER

SINUSOIDAL SHAPED STIFFENER

COMPLIANT TUBE BAFFLE

AIR SPRING BAFFLE

UNDERWATER ACOUSTIC BAFFLE ENHANCER

The invention described herein may be manufactured and used by or for the Government of the United States of America for governmental purposes without the payment of any royalties thereon or therefor.

BACKGROUND OF THE INVENTION

1. Field of the Invention

This invention is directed to a lightweight underwater acoustic reflector with enhanced performance and to a novel method for constructing the same.

2. Description of the Prior Art

Many approaches have been developed to minimize the transmission or reflection or waterborne acoustic energy with the introduction of sound ranging and detection. Since the advent of the submarine, the ingenuity of designers has been particularly drawn upon to frustrate the detection capabilities of an adversary by making or otherwise obliterating the reflection of a probing acoustic interrogation signal and also sound radiated by a vessel. The change of hull configuration has been utilized to reduce the reflected signature, however, this change has not been very successful since weight and pressure considerations had to be unduly compromised and the problem of evasion by the vessel was necessarily left to a commander's discretion. Bubbles have also been used to acoustically decoy or mask a submersible vessel, however, this method is only partially effective as the bubbles create a reflective air column that draws attention or tends to inadequately clothe a submersible from acoustic probing. Acoustic coatings bonded on to exposed surfaces of a submersible have also been used. Other items, such as, panels, various types of coatings and compliant layers have been attached onto the hulls of undersea craft. Most have been not entirely successful because of difficulty in applying them to and to retaining them on the exposed surfaces, often they do not conform readily to irregular contours and often are unstable in a submersible's environment with temperature and pressure variations. Many also experience limited time usefulness due to fatigue and failure. Further, for use underwater they are very expensive, most deteriorate rapidly in a seawater environment, they are vulnerable to damage during docking, and they exhibit inconsistent frequency responses over wide spectra.

One recent attempt to overcome the limitations imposed by the prior art is illustrated in U.S. Pat. No. 4,450,544 wherein the inventors illustrate an acoustical energy absorbing baffle for minimizing sound reflection and providing isolation from noise producing sources wherein the acoustical energy absorbing baffle has a pair of restricted orifice screens rigidly secured in parallel spaced relation by a lattice stiffener, said stiffener assembly is immersed in a viscous fluid contained within a tank sealed with an elastic diaphragm. Incident acoustical energy is transmitted through the diaphragm and translated into energy absorbing motion of the fluid through the restrictive screens. The fluid and screen are designed to match the impedance of water. An acoustically compliant layer is coupled to the fluid to augment fluid particle velocity through the screens and thus to further absorb energy. The viscous fluid utilized is a silicon oil. However, no baffle enhancement effect is obtained at the most desired and necessary low frequencies.

SUMMARY OF THE INVENTION

The present invention provides a lightweight underwater acoustic baffle with enhanced performance characteristics particularly at low frequencies and to the method for its manufacture. The lightweight underwater acoustic baffle yielding enhanced performance of this invention comprises a stiffened resistive screen means affixed in front of a compliant material for allowing the baffle to reflect on the compliant side and on the screen side, a rigid irregular shaped material means with a primary open surface area affixed to the screen as a means for attaining maximum stiffness with a minimum weight, a compliant means affixed behind said screen means, a water fluid sealing and container means within the baffle means for suffusing the stiffening core area and its attached screen and producing a greater impedance mismatch thus enhancing the insertion loss and baffle performance, and, attachmcnt means affixed to said container means for attachment to a vessel.

OBJECTS OF THE INVENTION

An object of the invention is to provide a lightweight underwater acoustic reflector with enhanced performance.

Another object of the invention is to provide a method for preparing a lightweight underwater acoustic reflector with enhanced performance.

Still another object of the invention is to provide a lightweight underwater acoustic reflector with enhanced performance particularly at low frequencies and to the method for its preparation.

Other objects and many of the attendant advantages and usage of the invention will be readily observed and appreciated as the same becomes better understood by reference to the following detailed description.

DESCRIPTION OF THE PREFERRED EMBODIMENTS

Figure 1:
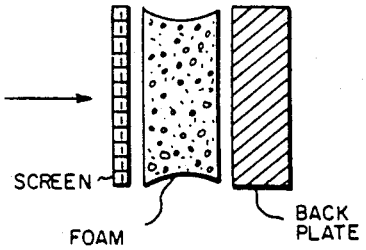
FIG. 1 is a side schematic cross-sectional view of the baffle of the invention.

FIG. 1 shows an embodiment of the lightweight underwater acoustic baffle enhancer yielding enhanced performance of the invention. The backplate is a two inch think steel representation of a ship hull to which a baffle is interposed for the purpose of isolating a hydrophone array from the machinery and flow induced vibration noise in the hull. An acoustically mismatched compliant material, such as, compliant tubes whose acoustic performance is minimally degraded by pressure, or, a polyurethane matrix with sixty percent air is used to reflect the unwanted noise back to the hull. The compliant material produces a high acoustic particle velocity at its surfaces. However, pressure sensitive piezoceramic hydrophones lose their acoustic sensitivity when placed in a region of high particle velocity such as is represented by the compliant material. The deficiency is overcome by placing a steel plate, which is of high mass impedance, between the compliant element and the hydrophone. A typical thickness for operation down to 2 KHz would be one inch of steel. Lower frequencies require a greater thickness of steel.

The compliant means can also be made from a compressible and contourable foam material, a plastic matrix having air inclusions that is compressible and pressure contourable, a compressible and pressure contourable compliant tube material, and a compressible and pressure contourable air spring baffle material.

The employment of hull mounted arrays for low frequencies has thus been inhibited by the need for copious quantities of steel for the signal conditioning plate application. This invention performs the function of a signal conditioning plate without adding great weight for low frequency operation.

This invention is a departure from the prior art that successfully replaced a steel plate with a stiffened resistance screen suffused with silicone oil that made a good acoustic impedance match with water, absorbed the incident acoustic energy, and caused the hydrophone to operate as if it were in free space. In this invention, the dissipative silicone oil is removed and water is used as the working fluid so that there is a very substantial impedance mismatch with water and the impedance of the steel plate is greatly enhanced. Impedance at low frequencies has traditionally been increased by the addition of mass to keep the acoustic inertance $j\omega m$ constant, where $$j=\sqrt{-1},$$

$$\omega=2\pi f \text{ angular frequency},$$

and $$m=\text{Mass}$$

It is apparent that as frequency is decreased the mass must be increased to maintain a constant $j\omega m$. The employment of great mass over large areas of a ship hull produced non-acoustic effects of great consequence that prohibited low frequency operation. For example, a vessel carrying a great mass requires a large volume to provide buoyancy. The greater volume and mass then requires a larger power plant, more fuel consumption and the propeller must work harder to propel the vessel, thus producing unacceptable radiated noise.

Figure 5A:
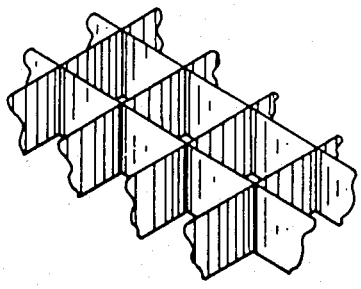
FIG. 5A is a lighweight, rigid, irregular shaped material means as in "an egg craft stiffener."
Figure 5B:
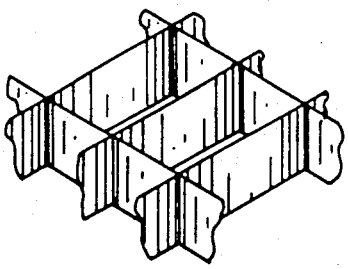
FIG. 5B is a lightweight, rigid, irregular shaped material means of a "rectangular shaped stiffener. "
Figure 5C:
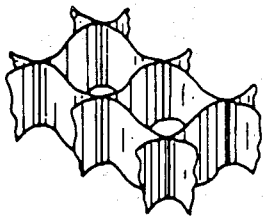
FIG. 5C is a lightweight, rigid, irregular shaped material means of a "sinosoidal shaped stiffener."
Figure 6:
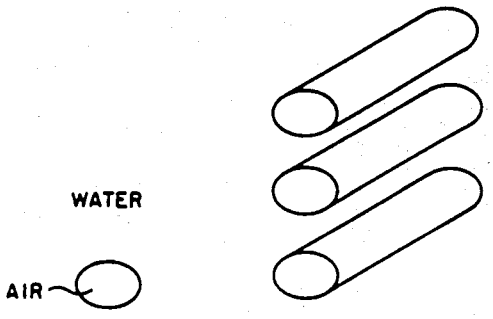
FIG. 6 illustrates a compliant tube material of a compressible and pressure contourable air spring baffle material.

A prior patent application by this inventor, Ser. No. 06/047,549, describes the method of designing a lightweight resistive screen and a lightweight stiffener suffused with a viscoelastic silicone fluid to produce acoustic dissipation of incident energy. To produce an acoustic resistance that will match the impedance of water the Hagen-Poiseuille Law is invoked to compute the dimensions of screen, stiffener, and fluid. A typical resistive screen would be a steel foil about 0.0001 inches thick; about sixty percent of the area would be composed of small holes also about 0.0001 inches in diameter. A viscoelastic fluid is then chosen via the Hagen-Poiseuille Law with a dynamic viscosity such that the flow resistance is 150,000 c.g.s. Rayls which is the impedance of water. The foil screen must not vibrate in order that the resistance can be produced. Previous vibrationlessness of the screens was attained by utilizing mass attached to the screen in order to maintain motionlessness. See U.S. Pat. No. 2,503,400. One important improvement of this invention to avoid mass attached to the screen, is the utilization of a lightweight stiffener, such as, an aircraft type Hexcel stiffener made by The Hexcel Corporation of Los Angeles, California to attain motionlessness. The stiffener is appropriately affixed to the foil screen with an adhesive or brazing process. Other type stiffeners utilizable in this invention are egg crate shaped material as illustrated in FIG. 5A, rectangular shaped materials, as illustrated in FIG. 5B and sinusoidal shaped materials as illustrated in FIG. 5C and FIG. 6.

Figure 1A:
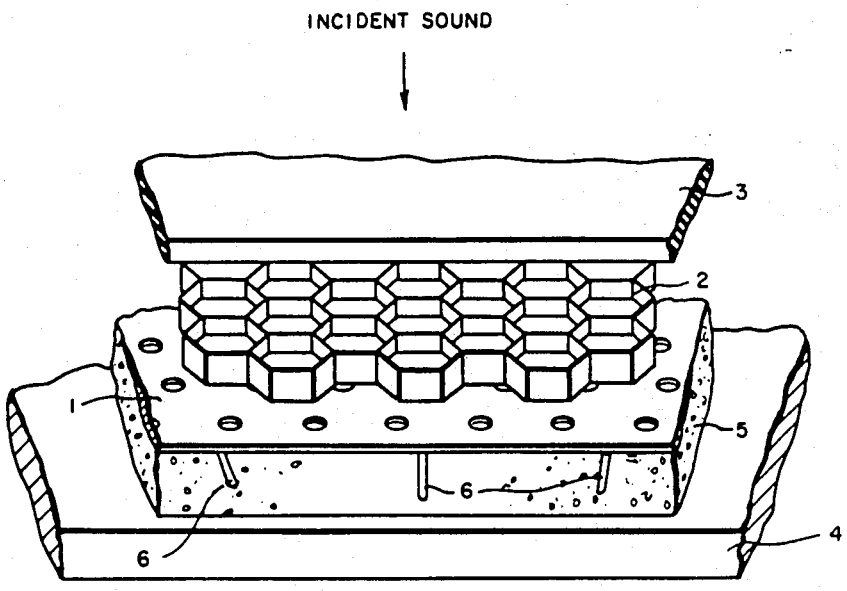
FIG. 1A is a detailed cross-sectional view of the baffle showing its components and its attachment to a backplate which may be a ship hull.

FIG. 1A is a representation of the baffle with its components and its attachment to a backplate such as a ship hull. Incident sound impinges upon a water fluid sealing and container means 3 which separates the sea water from the internal components which are suffused with fresh water so that corrosion is controlled. Etched screen 1 is brazed or bonded to irregular shaped lightweight stiffener 2. The baffle combination is attached to backplate 4 via support posts 6. Compliant material 5 is positioned between backplate 4 and screen 1 and acts as an acoustic reflector. FIG. 1A shows incident sound entering upon the screen side of the baffle. The opposite surface of the baffle, the compliant side, acts as an acoustic reflector to sound radiated from backplate 4 which is cause by machinery noise or flow induced vibrations and thur inhibits the radiation of the sound to an adversary's detection system. The etched screen 1 is preferably made of stainless steel and is 0.0001 inch thick with the apertures preferably 0.0001 inch in diameter. It also can be made of electro-chemically compatible material. The irregular shaped lightweight stiffener 2 is preferably made of stainless steel or other electrochemically compatible material and preferably one fourth inch thick. A water fluid scaling and container means 3 can be made of neoprene, steel or any material that is acoustically transparent at the frequencies in use. Complaint material 5 provides a pressure release surface and can be manufactured from air-filled foam elastomer, metal compliant tubes or air-filled rubber with macroscopic air inclusions. And, the support posts are preferably made of electro-chemically compatible materials, such as, stainless steel and monel alloy.

Figure 2:
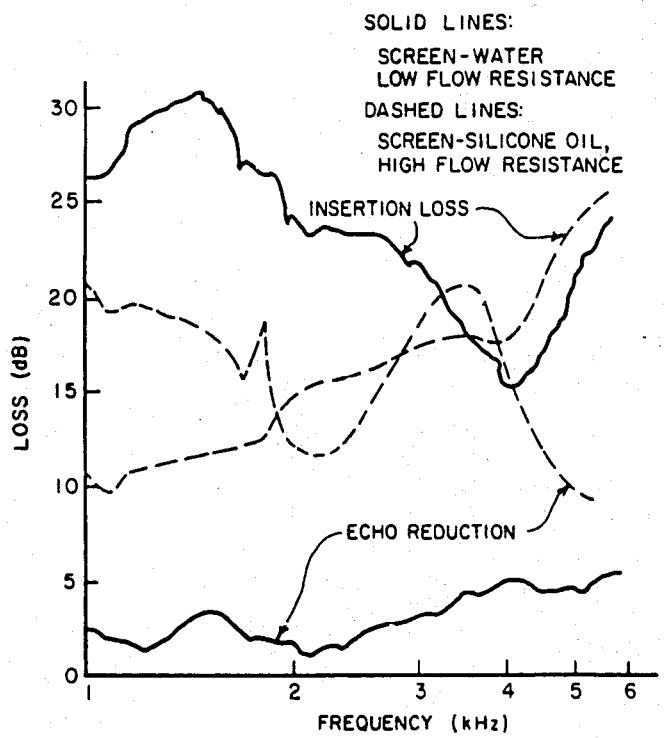
FIG. 2 illustrates the results of replacing a lossy silicone oil with non-lossy water in the baffle of the invention.

This invention uses the stiffened foil screen and replaces the viscoelastic fluid with low viscosity water so as to produce a miniscule acoustic resistance and thus a substantial impedance mismatch to an incoming acoustic signal. It is now a reflector at low frequencies. When affixed to the front of the back plate as shown in FIG. 1 the low frequency insertion loss is greatly enhanced. FIG. 2 shows the measured result of the stiffened screen described above wherein at 1.5 KHz, for example, the baffle insertion losses increased by about twenty decibels which is equivalent to acoustically adding many inches of thickness of steel plate material which would be an unacceptable weight increase causing degraded ship performance and increased radiated sound which would be detected by an adversary. The use of a submersible utilizing this invention allows it to become a superior listening platform to detect and to track an adversary by his low frequency acoustic emanations. Also, the quieter operation of a submersible to which this invention is affixed will make it a less inviting target, for example, wherein an adversary's ordnance capability utilizes radiated noise to lock onto.

This invention is a further improvement over the prior art wherein the hydrophones are encapsulated in rubber and placed above an oil filled, stiffened resistive screen. Such prior art is indeed a workable situation, however, rubber as the encapsulate supports shear waves, and shear waves produced by an explosive shock will destroy piezoceramic hydrophones. Thus, such types are not a viable alternative in useable current sound technology as the hydrophones would be destroyed by any explosive shock.

Figure 3:
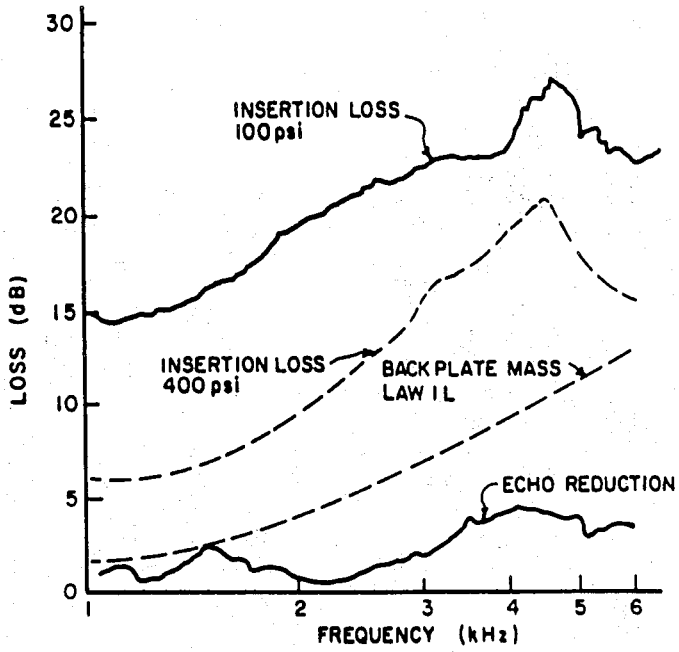
FIG. 3 illustrates Insertion Loss and Echo Reduction utilizing the invention.

FIG. 3 is the measured insertion loss of an air filled polyurethane foam with sixty percent air and a two inch thick steel backplate. The theoretical insertion loss of a two inch steel plate alone is shown as a comparison. FIG. 2 is the measured insertion loss of the FIG. 3 configuration with the baffle enhancer of this invention added. At 1.5 KHz, in FIG. 2 the insertion loss is impoved by seventeen decibels. It is noted that each addition of three decibels is equivalent to a doubling of the steel mass.

The lightweight underwater acoustic baffle of the invention is also utilizable as a coating to abate radiated noise from the surface to which it is attached.

The principle of the resistive screen baffle and its contribution in sound technology is shown and illustrated by this invention. A multi-purpose acoustic structure as shown by prior art is required to simultaneously exhibit the heretofore contradictory functions of reflecting and absorbing acoustic energy. Absorption in prior art is obtained from a resistive screen wherein the dissipation of the energy is produced by the friction of plugs of viscous fluid oscillating in very small pores of a rigid matrix at high velocity. A compliant layer represents a pressure release surface at which is located a high particle velocity. A resistive screen situated in a region of high acoustic particle velocity dissipates acoustic energy incident upon it. And, maximum dissipation is attained when the screen is motionless so that the highest relative fluid plug velocity attainable in the pore of a screen can be reached. The design of a screen for use as an anechoic signal conditioning plate in the range of 2-6 KHz addresses a set of parameters that are totally different from those that affect performance in a higher or lower frequency region. A requirement for a signal conditioning plate exists, when an array of hydrophones is mounted on a submarine hull. The machinery and other noise travels from the hull to the hydrophones causing a masking of the incoming acoustic signal. The noise is decoupled from the hydrophones through the insertion of a reflecting compliant layer between the hull and the hydrophone. However, the high acoustic particle velocity associated with the compliant layer desensitizes the pressure sensitive hydrophones. The normal response of the hydrophone is restored when a signal conditioning plate is inserted between the compliant layer and the hydrophone. A compliant layer can assure different forms. Air filled compliant tubes have shown good results. The acoustic performance of a soft compliant layer can be seriously degraded by hydrostatic pressure; however, the acoustic performance of a resistive screen is unaffected by hydrostatic pressure changes. It was observed that a combination of some resistive screen, compliant layers exhibit acoustic performance in which the echo reduction and the insertion loss are not degraded by pressure up to 400 psi.

Theoretical considerations show that the signal conditioning function can be formed by an anechoic layer with at least 6 dB of echo reduction and less than 90° of phase shift. By serendipity, echo reduction inherent in a resistive screen is activated when it is placed over a compliant layer with its high particle velocity. Therefore, a lightweight, resistive screen was designed to replace the heavy steel signal conditioning plate.

The preferred stiffened very thin foil screen and stiffening means utilized in this invention, among many reviewed, was designed to provide a lightweight underwater acoustic baffle having enhanced performance characteristics unattainable heretofore at low frequencies to enhance listening capability by a quantum improvement as illustrated in FIG. 3. Further, FIG. 2 shows the results of replacing the lossy silicone oil with non-lossy water and obtaining the improved performance. The screen, it was observed, possessed little or no dissipation, thus the improved insertion loss. It is seen that upon the removal of dissipation the echo reduction is reduced to a value close to experimental error and that the insertion loss is substantially increased. The insertion loss of the compliant element and back plate alone, as illustrated in FIG. 3 is lower and increased with frequency which is opposite to the effect seen in FIG. 2. An understanding is not yet known to explain how a reinforced perforated metal foil with insignificant flow resistance can enhance the low frequency insertion loss of the various compliant elements evaluated. Some speculation says that the reinforced, lossless screen is acting as a wave number filter thus causing the enhanced insertion loss. Such speculation, however, is not yet confirmed.

The preferred thin foil screen is about 0.0001 inch thick, appropriately affixed by an adhesive or brazing process to a stiffener about 0.25 inch made of lightweight aluminum of the Hexcel shape manufactured by the Hexcel Corporation of Los Angeles, Calif. The compliant element preferred is made of a cured polyurethane cellular elastomer having a density of twenty six pounds per cubic foot which is equivalent to sixty percent air. The compliant element can be formed to any contour and is sealed to keep the water out and is pressed to a permanent configuration as desired. Other types of cellular elastomers for the compliant element and sealing type container materials for said compliant element can also be utilized.

Figure 4:
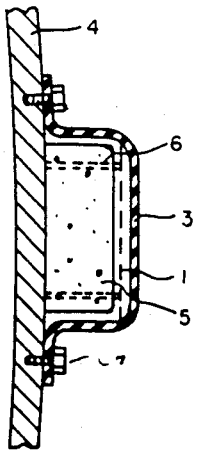
FIG. 4 is a water fluid sealing and container means within said baffle means.
Figure 7:
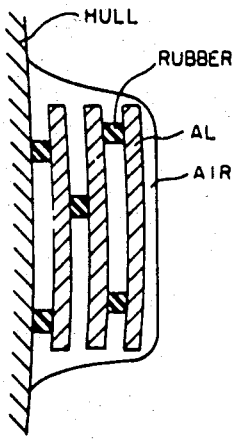
FIG. 7 illustrates a compressible and pressure contourable air spring baffle material.

This invention is useful to enhance system operation and provide acoustic control on surface ship and submersible sonar systems with various configurations as illustrated in FIGS. 4 and 7. Its specific placement depends upon noise emanations from the vessel whether surface or submersible type.

While the invention has been described in its preferred embodiments, it is to be understood that the words used are words of description rather than limitation and that changes may be made within the purview of the appended claims without parting from the spirit and true scope of the invention.

What is claimed is:

1. A lightweight underwater acoustic baffle yielding enhance performance comprising:

(a) a lightweight stiffened resistance screen means affixed in front of a compliant material means having a compliant side and a screen side for allowing said baffle to reflect on the compliant side and the screen side;

(b) a lightweight rigid irregular shaped material means with a primary open surface area affixed to said screen means for attaining maximum stiffness with a minium weight of said screen;

(c) a compliant means affixed behind said screen means;

(d) a water fluid sealing and container means within said baffle means for suffusing the stiffening core area and its attached screen and producing a greater impedance mismatch thus enhancing baffle performance; and (e) attachment means affixed to said container means for attachment to a vessel.

2. An improved method for preparing a lightweight underwater acoustic baffle yielding enhanced performance comprising:

(a) affixing a lightweight stiffened resistance screen means in front of a complaint material means having a compliant side and a screen side for allowing said baffle to reflect on the compliant side and on the screen side;

(b) attaching a rigid irregular shaped material means with a primary open surface area to said screen means for attaining maximum stiffness with a minimum weight of said screen;

(c) affixing a compliant means behind said screen means for assiting in allowing said baffle to reflect on the compliant side and on the screen side; and (d) containerizing water fluid means for encompassing said baffle and its contents and for attachment to vessel for enhancing its acoustic performance.

3. A lightweight underwater acoustic baffle as in claim 1 wherein the lightweight stiffened resistance screen is a perforated foil about 0.0001 inch in diameter and having about 60% open perforation area.

4. A lightweight underwater acoustic baffle as in claim 1 wherein the lightweight rigid irregular shaped material means is a hexagon shaped stiffener material about ¼ inch in diameter and made of a lightweight metal.

5. A lightweight underwater acoustic baffle as in claim 1 wherein the lightweight rigid irregular shaped material means is an egg crate stiffener material about ¼ inch in diameter and made of a lightweight metal.

6. A lightweight underwater acoustic baffle as in claim 1 wherein the lightweight rigid irregular shaped material means is a rectangular shaped stiffener material about ¼ inch in diameter and made of a lightweight metal.

7. A lightweight underwater acoustic baffle as in claim 1 wherein the lightweight rigid irregular shaped material means is a sinusoidal shaped stiffener material about ¼ inch in diameter and made of a lightweight metal.

8. A lightweight underwater acoustic baffle as in claim 1 wherein the compliant means is a compressible and pressure contourable material having a density of twenty-six pounds per cubic foot.

9. A lightweight underwater acoustic baffle as in claim 8 wherein the compliant means is a compressible and pressure contourable foam material.

10. A lightweight underwater acoustic baffle as in claim 1 wherein the compliant means is a plastic matrix having air inclusions and is compressible and pressure contourable.

11. A lightweight underwater acoustic baffle as in claim 1 wherein the compliant means is a compressible and pressure contourable compliant tube material.

12. A lightweight underwater acoustic baffle as in claim 1 wherein the compliant means is a compressible and pressure contourable air spring baffle material.

13. A lightweight underwater acoustic baffle as in claim 1 wherein the container means is the means required to be attachable to a vessel.

14. A lightweight underwater acoustic baffle as in claim 1 wherein the sealing means is a lightweight waterproof material.

15. A lightweight underwater acoustic baffle as in claim 1 wherein said attachment means is permanently affixed to said container means and portably affixed to a vessel.

16. A lightweight underwater acoustic baffle as in claim 1 wherein the enhanced baffle performance is obtained at low frequencies.

17. A lightweight underwater acoustic baffle as in claim 1 wherein said baffle acts as a coating to abate radiated noise from the surface to which it is affixed.

* * * * *